United States Patent [19]

Niwata et al.

[11] Patent Number: 5,036,640

[45] Date of Patent: Aug. 6, 1991

[54] WINDOW

[75] Inventors: Sotoharu Niwata, Toyama; Eiryo Ogami, Osaka, both of Japan

[73] Assignee: Yoshida Kogyo K. K., Tokyo, Japan

[21] Appl. No.: 457,578

[22] Filed: Dec. 27, 1989

[30] Foreign Application Priority Data

Dec. 28, 1988 [JP] Japan ..... 63-32981
Aug. 1, 1989 [JP] Japan ..... 1-197927

[51] Int. Cl.[5] ..... E04B 2/88
[52] U.S. Cl. ..... 52/235
[58] Field of Search ..... 52/235

[56] References Cited

U.S. PATENT DOCUMENTS 4,665,662 5/1987 Swanborn ..... 52/235
4,738,065 4/1988 Crandell ..... 52/235

FOREIGN PATENT DOCUMENTS 0168097 1/1986 European Pat. Off. .
63-268849 11/1988 Japan .

*Primary Examiner*—John E. Murtagh

*Attorney, Agent, or Firm*—Hill, Van Santen, Steadman & Simpson

[57] ABSTRACT

A window comprising: at least a pair of left and right connection attachments for mounting a window frame thereof which are fixedly secured to two mutually adjacent portions of an external wall of a building; at least a pair of left and right pivotable members whose inner ends are pivotally mounted on the connection attachments, respectively, such that they may be swung freely about their respective pivotal axes, and whose outer ends are integrally formed in their respective engaging pieces; at least a pair of left and right engaging members each having an engaging recess formed therein and which opens so as to be detachably engaged with each of the engaging pieces of the pivotable members; and a panel adhesively bonded along at least inner left and right vertical margins thereof onto the outer surfaces of the engaging members, respectively. The window is arranged such that upon mounting the panel, each of the engaging pieces is fitted sufficiently in each of the engaging recesses.

6 Claims, 12 Drawing Sheets

WINDOW

BACKGROUND OF THE INVENTION

1. Field of the Invention

This invention relates to a window wherein a panel is mounted in a window frame in such a manner as to cover the outer surfaces of mullions or vertical frame members which are components of the window frame.

2. Description of the Prior Art

There is so far known a window comprising a rectangular window frame formed by a pair of upper and lower horizontal frame members, and a pair of left and right vertical frame members assembled therewith, and a panel whose upper and lower margins are fitted in and supported by the downward recess of the upper horizontal frame member and the upward recess of the lower horizontal frame member, the arrangement being made such that the pair of left and right vertical frame members are covered with the panel by adhesively bonding the inner left and right vertical margins of the panel onto the outer surfaces of the pair of left and right vertical frame members, respectively.

Further, as described in Japanese Laid-Open Specification No. SHO 63-268849 of Japanese Patent Application, there is also known a window which comprises a window frame including at least a pair of mutually adjacent left and right mullions having engaging flanges formed integrally therewith, and a panel whose left and right vertical margins are adhesively bonded to two vertical frames having U-shaped and inverted U-shaped sections, respectively, so as to form openings adapted to be engaged with these left and right engaging flanges, the panel being mounted on the outer surfaces of the left and right mullions so as to cover the latter.

The former prior art window is pleasing in appearance since the pair of left and right vertical frame members cannot be seen from the outdoor side; however, in case of damage of the panel, etc., replacement of the panel is difficult since the outer left and right margins of the panel are adhesively bonded to the outer surfaces of the pair of left and right vertical frame members, respectively.

The latter window disclosed in the above-mentioned Japanese Laid-Open Patent Application has the following disadvantages.

(1) In case the panel is mounted:

The above-mentioned vertical frames are adhesively bonded to the left and right vertical margins, respectively, of the panel. Subsequently, the panel in such a condition is located diagonally relative to the panel mounting surface, and the flange on one side thereof is engaged with or fitted in the opening in the vertical frame on one side thereof. Then, the panel is turned in a horizontal plane about the engaging portion on one side thereof which serves as a fulcrum (or center) so as to locate the surface of the panel flush with the panel mounting surface. After that, the panel is moved towards the engaging flange on the other side thereof and in parallel thereto so as to engage the latter with the opening of the vertical frame bonded to the other margin of the panel.

Thus, the heavy panel must be moved obliquely in one direction, or moved in parallel, or to another direction so that the panel mounting work becomes very troublesome. Further, once the engaging flange on one side thereof has been engaged with the opening of the vertical frame on one side thereof, the panel is moved in parallel so as to allow the engaging flange on the other side thereof to engage with the opening of the vertical frame on the other side thereof, and as a result, the length of engagement of the vertical frames bonded to the left and right vertical margins of the panel with the left and right engaging flanges becomes short thereby weakening the strength of the panel mounted portions.

(2) In case the panel is dismounted:

The operations mentioned in the above item (1) are conducted in reverse order, and therefore the panel removal work is very troublesome.

SUMMARY OF THE INVENTION

The present invention has been made in view of the above-mentioned circumstances in the prior art, and has for its object to provide a window wherein the panel mounting/dismounting operation can be made readily and simply, and the panel can be mounted in the window frame with a high mounting strength.

To achieve the above-mentioned object, according to a principal aspect of the present invention, there is provided a window comprising: as components for mounting a window frame thereof, at least a pair of connection attachments fixedly secured to two mutually adjacent portions of an external wall of a building; at least a pair of left and right pivotable members whose inner ends are pivotally mounted on the pair of left and right connection attachments, respectively, such that they may be swung freely about their respective pivotal axes, and whose outer ends are formed in their respective engaging pieces formed integrally therewith; at least a pair of left and right engaging members each having an engaging recess formed therein and which opens so as to be detachably engaged with each of the engaging pieces of the pair of left and right pivotal members; and a panel adhesively bonded along at least the inner left and right vertical margins thereof onto the outer surfaces of the engaging members, respectively, the arrangement being made such that upon mounting the panel each of the engaging pieces of the pair of left and right pivotable members is fitted sufficiently in each of the engaging recesses formed in the pair of left and right engaging members, respectively.

According to the present invention incorporating the above-mentioned aspect, in the window wherein the panel is mounted in the window frame so as to cover the outer surfaces of the mullions or vertical frame members forming components of the window frame, since the panel can be mounted/dismounted by swinging the pair of left and right pivotable members to the left and to the right in a horizontal plane, the panel mounting and dismounting operations can be made very easily. Furthermore, since the length of engagement of each of the engaging pieces of the pair of left and right pivotable members with each of the engaging recesses formed in the engaging members bonded to the inner left and right vertical margins of the panel can be increased thus increasing the strength of the panel mounted portions.

The above-mentioned and other objects, aspects and advantages of the present invention will become apparent to those skilled in the art by making reference to the following description and the accompanying drawings in which preferred embodiments incorporating the principles of the invention are shown by way of example only.

BRIEF DESCRIPTION OF THE DRAWINGS

FIG. 6 is a fragmentary, schematic cross-sectional view of the embodiment, and FIG. 7 is a fragmentary, schematic longitudinal view of the same;

DETAILED DESCRIPTION OF PREFERRED EMBODIMENTS

The present invention will now be described in detail below by way of several preferred embodiments and variants thereof with reference to the accompanying drawings.

In the first place, the first embodiment of the present invention will be described with reference to FIGS. 1 to 5.

Figure 1:
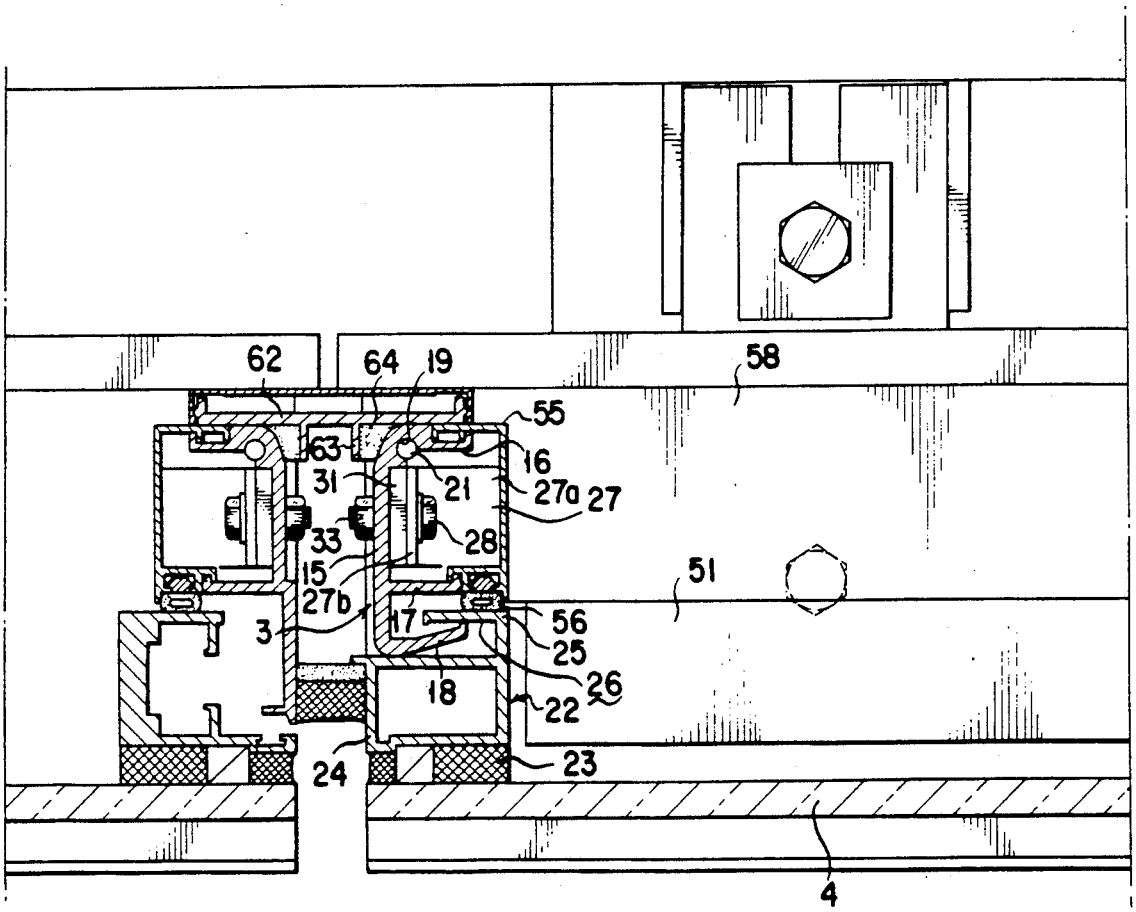
FIG. 1 is a fragmentary, schematic cross-sectional view showing a first embodiment of the present invention.
Figure 2:
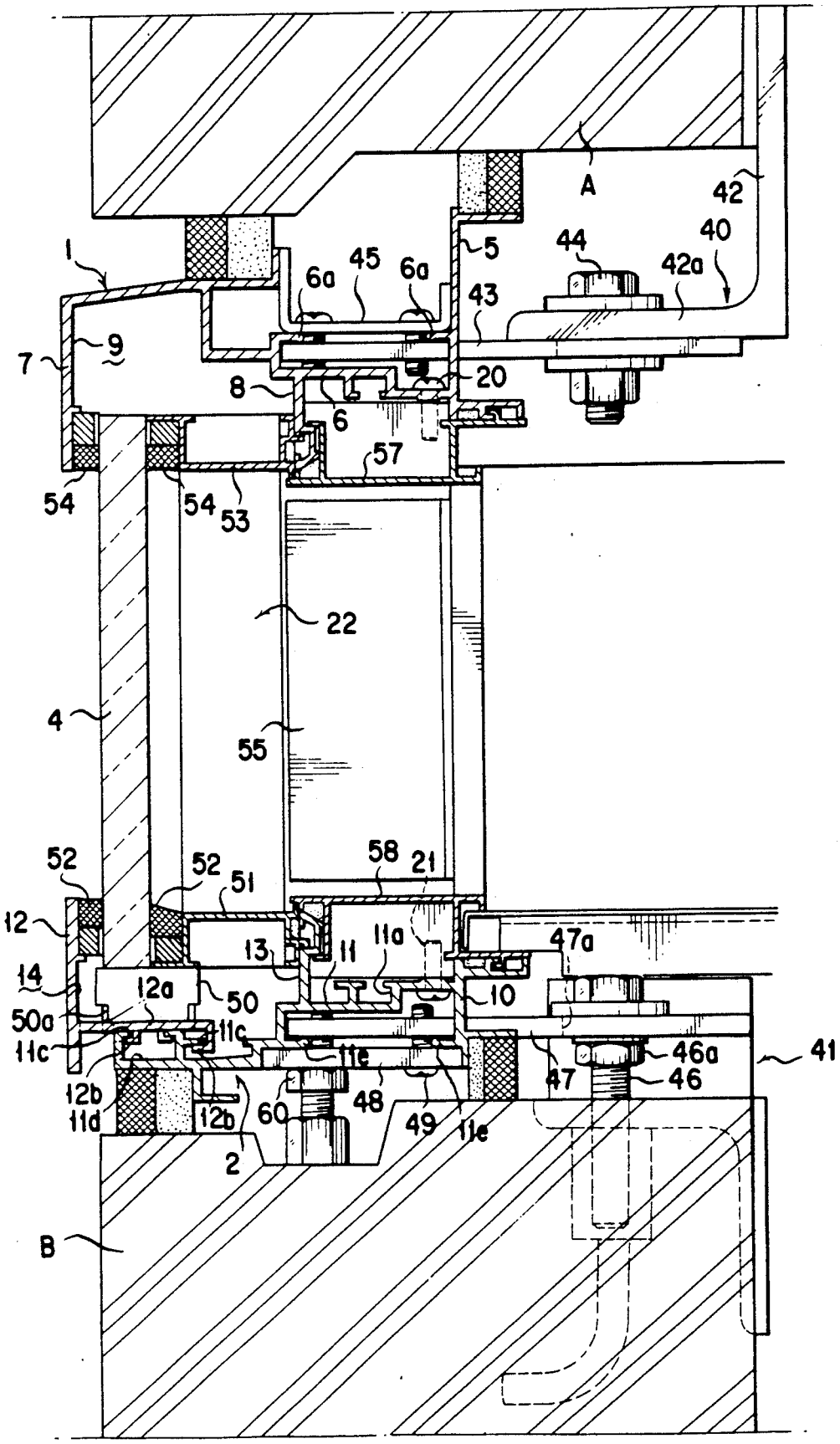
FIG. 2 is a schematic, longitudinal sectional view of the embodiment shown in FIG. 1.

As shown in FIG. 1 and 2, a rectangular window frame is formed by an upper horizontal frame member 1, a lower horizontal frame member 2, and left and right vertical frame members 3, 3, and a panel 4 is mounted on the outdoor side of the window frame.

The above-mentioned upper horizontal frame member 1 is formed by an inner vertical plate 5, a horizontal plate 6, an outer vertical frame 7, and an intermediate downwardly extending piece 8 so as to form a downward recess 9 on the outdoor side thereof, whilst the lower horizontal frame 2 is formed by an inner vertical plate 10, a horizontal plate 11, an outer vertical plate 12, and an intermediate rising piece 13 so as to form an upward recess 14 on the outdoor side thereof. The outer vertical plate 12 comprises a horizontal piece **12*a* having engaging pieces 12*b* formed integrally therewith. The engaging pieces 12*b* are engaged with engaging pieces 11*c*, respectively, formed on the outdoor side of the horizontal plate 11**, from both the indoor and outdoor sides thereof, and connected thereto.

The above-mentioned vertical frame member 3, which serves as a pivotable member, comprises a plate-shaped body 15 having an inner inward piece 16, an outer inward piece 17, and a hook-shaped engaging piece 18 formed integrally therewith. The above-mentioned vertical frame members 3 have an estimated length shorter than the above-mentioned upper and lower horizontal frame members 1 and 2, and are mounted on the inner side portions between the horizontal plates 6 and 11 of the upper and lower horizontal members 1 and 2, respectively. Each of the vertical frame members 3 is mounted such that it may be pivotted freely in a horizontal plane about upper and lower vertical screws 20 and 21 inserted from the horizontal plate 6 and 11 of the upper and lower horizontal frame members 1 and 2 into circular vertical holes 19 formed in the body 15 on the indoor side.

A pair of engaging members 22, 22 for panel mounting purposes are adhesively bonded through structural seals 23 onto the indoor side left and right longitudinal margins of the above-mentioned panel 4. Each of the engaging members 22 for panel mounting purposes comprises a hollow body 24 having a hook-shaped engaging and receiving piece 25 formed integrally on the indoor side thereof so as to form an engaging recess 26 which opens in the direction of each of lateral end faces of the panel 4. Each of the vertical frame members 3 is detachably connected to the engaging member 22 for panel mounting purposes by fitting the engaging piece 18 in the engaging recess 26, and as shown in FIG. 3, the body 15 of the vertical frame member 3 is connected by means of a bolt 28 to a metal connector 27 mounted on the horizontal plate 11 of the lower horizontal frame member 2.

Figure 3:
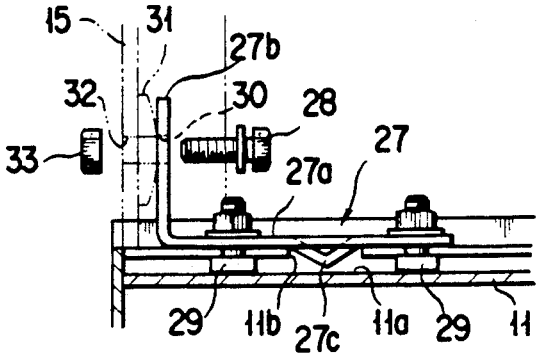
FIG. 3 is a sectional view of the metal connector mounting portion.

As shown in FIG. 3, the above-mentioned metal connector 27 formed by a horizontal plate **27*a* and a vertical plate 27*b* in an L-shaped configuration. The horizontal plate 27*a* is mounted on the horizontal plate 11 by means of bolts 29 fitted in grooves 11*a* formed in the horizontal plate 11, and a bolt 28 is inserted through a through-hole 30 formed in the vertical plate 27*b*, a strap 31 abutted against the body 15 of the vertical frame member 3, and a hole 32 formed in the body 15, and then a nut 33 is threadably engaged with the bolt 28 thereby connecting the vertical frame to the metal connector 27**.

Further, the hole 32 in the body 15 may be formed as a threaded hole which can threadably be engaged with the bolt 28. By so doing, a double-nut mechanism is obtained together with the nut 33 thereby enabling the components to be locked, and also the vertical frame member 3 can be turned laterally with the nut 33 removed and the bolt 28 loosened from the threaded hole 32 and without having to remove the bolt 28.

Further, the horizontal plate **27*a* has an embossed projection 27*c* adapted to be fitted in a cut-away portion 11*b* to enable positioning of the horizontal plate 27*a*** to be made.

Moreover, the horizontal plate 11 has a groove **11*d* formed therein and having a receiving piece 50*a* mounted thereon. The receiving piece 50*a* has a setting block 50 mounted thereon. The lower portion of the panel 4 is located on the setting block 50 and supported in the upward recess 14 of the lower horizontal member 2 by a lower batten 51 and a sealing material 52. The upper portion of the panel 4 is supported in the downward recess 9 of the upper horizontal frame member 1 by an upper batten 53 and a sealing member 54. A vertical cover 55 is mounted on the inner inward piece 16 and the outer inward piece 17. The vertical cover 55 has a vertical air-tight sealing material 56 mounted thereon and which is pressed against the engaging and receiving piece 25 of the engaging member 22 for panel mounting purposes. Further, an upper cover 57 is mounted on the inner vertical plate 5 and the intermediate downwardly extending piece 8 of the upper horizontal frame member 1, whilst a lower cover 58 is mounted on the inner vertical plate 10 and the intermediate rising piece 13 of the lower horizontal frame member 2. Furthermore, the horizontal piece 12*a* of the outer vertical plate 12 has a cut-away portion in which the above-mentioned setting block 50** is fitted.

Figure 4:
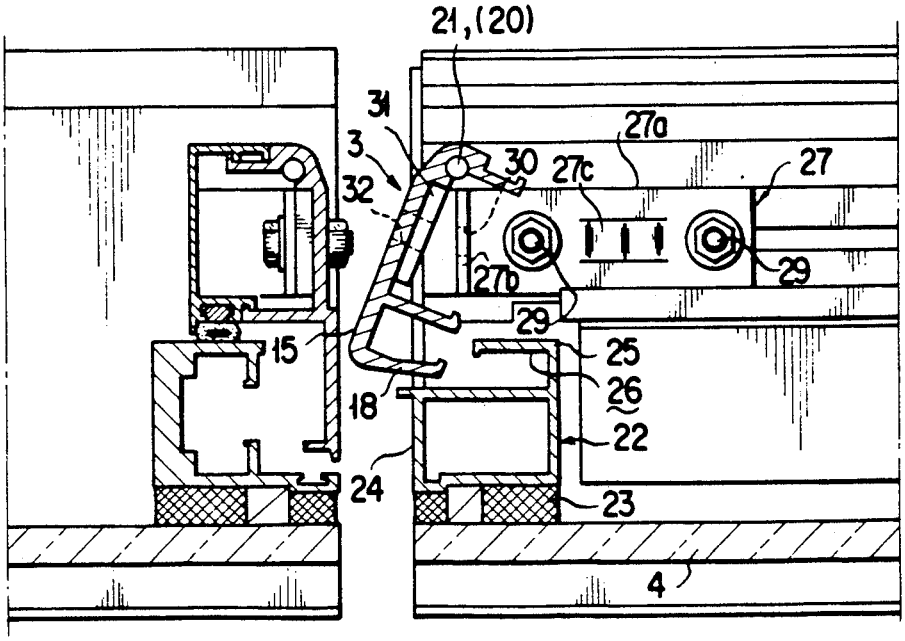
FIG. 4 is a fragmentary, schematic cross-sectional view showing a panel mounting/dismounting condition in the first embodiment.

Such being the arrangement, the vertical frame member 3 can be turned freely about the upper and lower vertical screws 20 and 21 to the left and right, and the engaging piece 18 of the vertical frame member 3 is engageable and disengageable with the engaging recess 26 of the engaging member 22 for panel mounting purposes as shown in FIGS. 1 and 4 so that the panel 4 can be mounted in and dismounted from the window frame to thereby enable replacement of the panel 4 to be made readily.

Stating in brief, the panel 4 can be mounted on the outdoor side of the window frame by resting the panel 4 on the setting block 50, turning the vertical frame member 3 inwardly so as to engage the engaging piece 18 with the engaging recess 26, connecting the vertical frame member 3 to the metal connector 27 by means of the bolt 28 and the nut 33, mounting the upper and lower battens 53 and 51, mounting the sealing members 54 and 52, mounting the panel 4, and then mounting the vertical cover 55 and the upper and lower covers 57 and 58.

By conducting the above-mentioned procedure reversely, the panel 4 can be dismounted readily from the window frame. Further, the upper and lower battens 53 and 51, and the upper and lower covers 57 and 58 may be mounted before resting the panel 4 on the setting block 50.

Next, the procedure of mounting the window frame will be described.

The upper horizontal frame member 1 is mounted on the upper part "A" of a building main body by means of an upper fastener 40 as a connection attachment, whilst the lower horizontal frame member 2 is mounted on the lower part "B" of the building main body by means of a lower fastener 41 as a connection attachment. The upper fastener 40 consists of a L-shaped primary fastener 42 and a plate-shaped secondary fastener 43. The primary fastener 42 has a horizontal piece 42*a* which is connected to the secondary fastener 43 by means of bolts 44 in the manner such that positional adjustment of the secondary fastener 43 in the indoor and outdoor directions may be made. The secondary fastener 43 is abutted against receiving pieces 6*a*, 6*a* of the horizontal plate 6 of the upper horizontal frame member 1 and connected to a bracket metal 45 by means of bolts.

Figure 5:
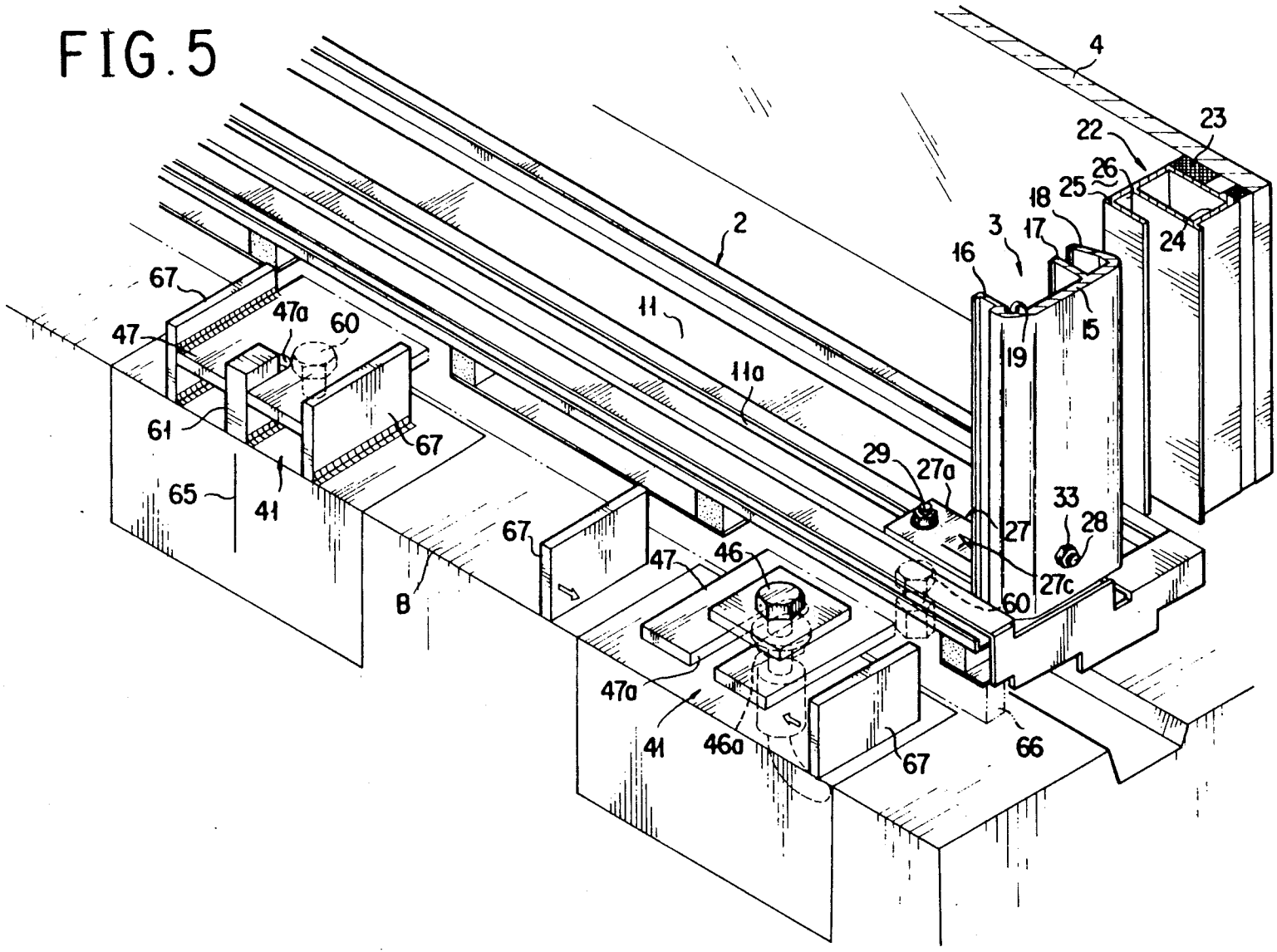
FIG. 5 is an exploded perspective view showing a lower fastener portion of the first embodiment.

As shown in FIGS. 2 and 5, the above-mentioned lower fasteners 41 are secured to the left and right and central portions of the lower horizontal frame member 2. Each of the left and right lower fasteners 41 serving as connection attachments has a mounting plate 47 having an elongated groove 47*a* formed therethrough so as to extend in the indoor and outdoor directions and through which a stud bolt 46 is inserted and tightened by a nut 46*a*. The mounting plate 47 is connected and tightened through a rear plate 48 to a pair of receiving pieces 11*e*, 11*e* of the horizontal plate 11 of the lower horizontal frame member 2 by means of bolts 49. Level adjusting bolts 60 are abutted against the rear plate 48. A positioning block 61 fixedly secured to the lower part B of the building main body is fitted in the elongated hole 47*a* in the mounting plate 47 of the central lower fastener 41 to enable the positioning of the latter in the vertical plane to be made, and a level adjustment is made by means of the level adjusting bolts 60 provided at three places.

Further, in FIG. 1, reference numeral 62 denotes a connection attachment having projection pieces 63, and a sealing material 64 is mounted on the projecting piece 63 and the vertical frame member 3.

The above-mentioned window frame is mounted in the following manner.

The positioning block 61 is aligned with a center line 65 marked with an India ink and fixedly secured by welding to the lower part B of the building main body, and then a level adjustment is made by adjusting the three level adjusting bolts 60.

The left and right vertical frame members 3, 3 are connected to the upper and lower horizontal frame members 1 and 2 to assemble the window frame, and the mounting brackets 47 are mounted on the left, right and central portions, respectively, of the horizontal plate 11 of the lower horizontal frame member 2. And then, the positioning block 61 is fitted in the elongated groove 47*a* in the central mounting plate 47 so as to make the positioning of the latter in the vertical plane, and at the same time stud bolts 46 are inserted through the elongated holes 47*a* formed through the left and right mounting plates 47, tightened temporarily for positional adjustments, and then tightened fully.

After mounting a secondary sealing member 66 on the horizontal member 11, faster plates 67 are welded to each of the mounting plates 47, an-d then the panel 4 is mounted as mentioned hereinabove.

Next, a second embodiment of the present invention will be described with reference to FIGS. 6 and 7.

Figure 6:
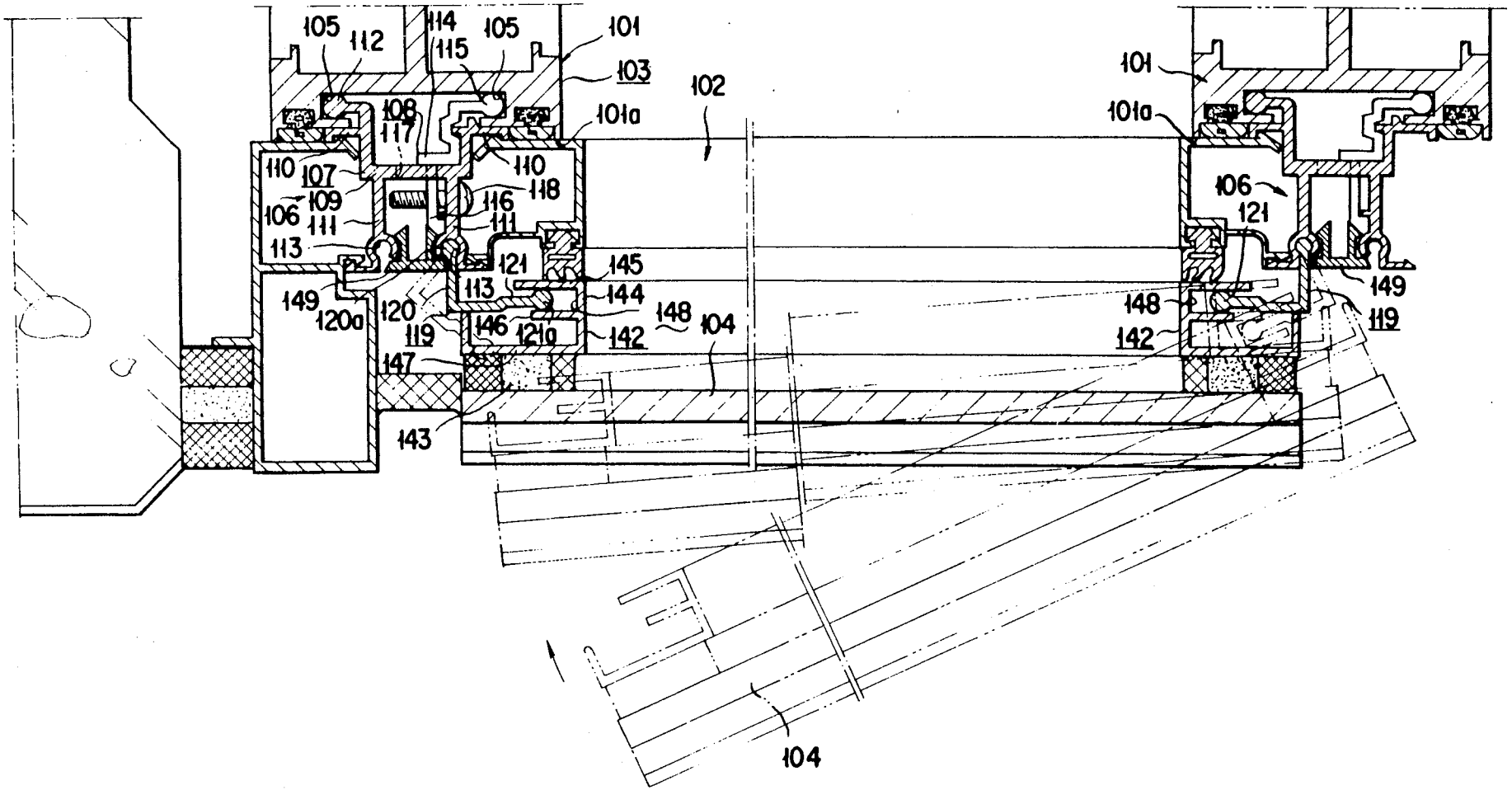
FIGS. 6 and 7 show a second embodiment of the present invention.
Figure 7:
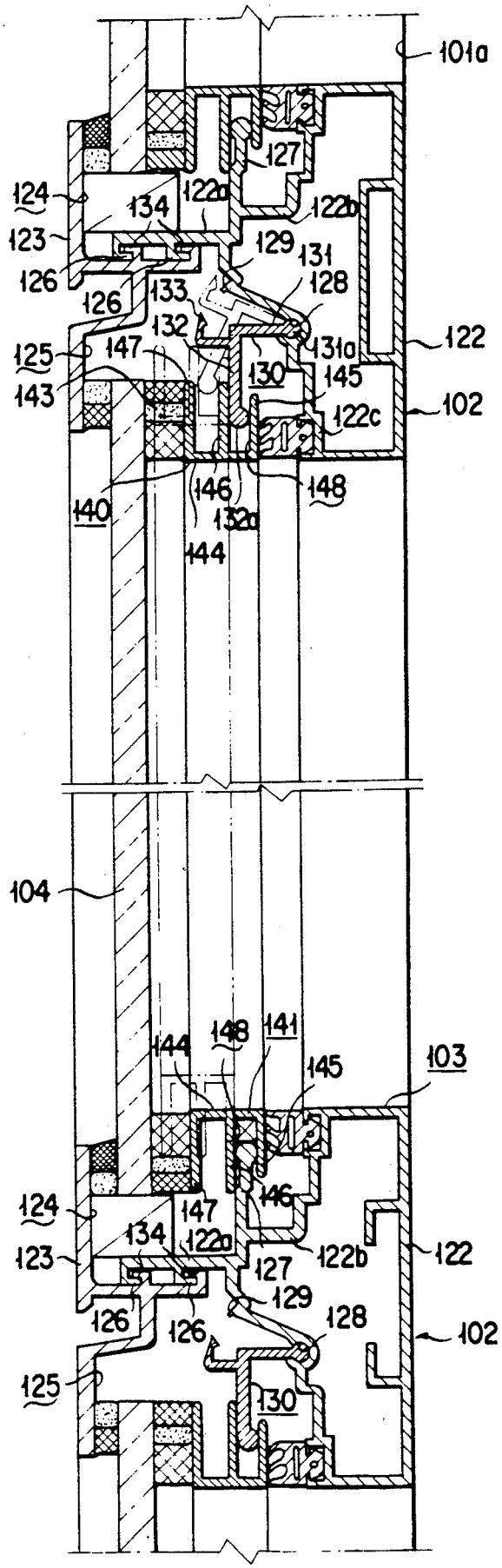

As shown in FIGS. 6 and 7, upper and lower horizontally extending transoms 102 are mounted between the outer surfaces 101*a* of mullions 101 in a vertically spaced apart relationship to form a rectangular window frame 103, in which a panel 104 is mounted.

Each of the mullions 101 has a pair of left and right engaging recesses 105, 105 formed on the outside thereof opposite each other and in which a bracket 106 which serves as a connection attachment is fitted and mounted.

Each of the above-mentioned brackets 106 comprises a bracket body 107 and an auxiliary piece 108. The bracket body 107 comprises a base piece 109 having a pair of support pieces 110, 110 formed integrally on the indoor side thereof and a pair of mounting pieces 111, 111 formed integrally on the outdoor side thereof. One of the support pieces 110 has a stationary engaging portion 112 formed integrally therewith, and each of the pair of mounting pieces 111, 111 has a substantially semi-circular recess 113 formed on the leading end thereof and extending in the longitudinal direction.

The above-mentioned auxiliary piece 108 comprises a base piece 114 having a hook-shaped movable engaging portion 115 formed integrally on the indoor side thereof, and a connecting piece 116 formed integrally on the outdoor side thereof. The connecting piece 116 is projected through an opening or aperture formed through the base piece 109 of the bracket body 107 to the outdoor side, and is connected and tightened to one of the mounting pieces 111 by means of a screw 118.

Thus, in order to mount the bracket 106 on the mullion 101, the screw 118 is firstly loosened, and then the auxiliary piece 108 is moved towards the stationary engaging portion 112 so as to make the spacing between the stationary engaging portion 112 and the movable engaging portion 115 less than the distance between the pair of engaging recesses 105, 105. Then, in this condition, the stationary engaging portion 112 and the movable engaging portion 115 are located opposite to the pair of engaging recesses 105, 105, and then the screw 118 is tightened to fixedly secure the connecting piece 116 of the auxiliary piece 108 to one of the mounting pieces 11 of the bracket body 107 to thereby engage and mount the stationary engaging portion 112 and the movable engaging portion 115 in the pair of engaging recesses 105 and 105.

Thus, the bracket 106 can be mounted on the mullion 101 readily from the outdoor side.

Further, the bracket body 107 of the bracket 106 may be a long one or a short one.

The mounting piece 111 of the above-mentioned bracket body 107 has a recess 113 formed in the outdoor side thereof and in which the inner end of a pivotable member 119 is pivotally mounted so that it may be swung to the left and to the right. The pivotable member 119 is formed in a substantially L-shape by an inner mounting base piece 120 and an outer engaging piece 121. The mounting base piece 120 has a bulging portion **120*a* formed integrally therewith and adapted to be pivotally mounted in the recess 113, whilst the engaging piece 121 has a bulging portion 121*a*** formed on the leading end thereof.

As shown in FIG. 7, the above-mentioned transom 102 is comprised of a transom body 122 located at an inner position and a cover member 123 located at an outer position so as to form an upward recess 124 and a downward recess 125. The transom body 122 includes an outwardly extending horizontal plate **122*a* formed integrally therewith and having an engaging hook-shaped piece 126 formed integrally therewith, an upper plate 122*b* having an upwardly extending engaging projection piece 127 formed integrally on the outside thereof, and a lower plate 122*c* having a substantially semi-circular groove or recess 128 formed in the intermediate portion thereof and also having an engaging portion 129 formed integrally therewith above the groove 128**.

An upper pivotable member 130 comprises an inner mounting base piece 131. The mounting base piece 131 has a bulging portion **128*a* formed integrally on the leading end thereof and which is fitted in the above-mentioned groove or recess 128. The above-mentioned mounting base piece 131 has a downwardly extending outer engaging piece 132 formed integrally therewith so as to form the upper pivotable member 130 in a hook shape. The upper pivotable member 130 has also an outwardly extending engaging portion 133 formed integrally therewith, and the engaging piece 132 has a bulging portion 132*a*** formed integrally on the lower, leading end thereof.

The above-mentioned cover member 123 has an engaging hook-shaped piece 134 formed integrally therewith. The engaging hook-shaped piece 134 is engaged with the engaging hook-shaped piece 126 of the transom body 122 so that the cover material can detachably mounted on the transom body 122.

The above-mentioned panel 104 has an upper horizontal member 140, a lower horizontal member 141, and vertical members 142 which serve as engaging members and are bonded by means of an adhesive 143 onto the inner surfaces of the upper, lower and vertical margins thereof, respectively. Each of the upper horizontal member 140, the lower horizontal member 141 and the vertical members 142 is a long member formed in a substantially E-shaped section by an inner plate 144, an inner side plate 145, an intermediate plate 146, and an outer side plate 147 so as to define an engaging recess 148 which opens towards the end face of the panel. The outer side plates 147 of the upper and lower horizontal members 140, 141 and the vertical members 142 are adhesively bonded by means of adhesive 143 to the panel 104.

The engaging piece 121 of the pivotable member 119 pivotally mounted on the bracket 106 is fitted in or engaged with the engaging recess 148 of the vertical member 142. The engaging piece 132 of the upper pivotable member 130 is fitted in or engaged with the engaging recess 148 of the upper horizontal member 140, and also the engaging projection piece 127 is fitted in or engaged with the engaging recess 148 of the lower horizontal member 141 thereby mounting the panel 104 in the window frame 103.

The procedure of mounting the panel 104 in the window frame will be described below in a sequence of steps.

(1) Remove the cover member 123 of the transom 102 and engage the engaging portion 133 of the upper pivotable member 130 with the engaging portion 129 so as to keep the upper pivotable member 130 in its upwardly swung condition.

(2) Swing towards the outdoor side the pivotable member 119 connected to the bracket body 107 of the bracket 106 mounted on one of the mullions 101, engage the engaging piece 121 with the engaging recess 148 of one of the vertical members 142, and temporarily tighten the panel 104 obliquely as shown by imaginary line in FIG. 6.

(3) Swing the panel 104 together with one of the pivotable members 119 in the direction shown by the arrow in FIG. 6, and swing the other pivotable member 119 to the outdoor side so as to engage its engaging piece 121 somewhat with the engaging recess 148 of the other vertical member 142.

(4) Move the panel 104 upwards so as to raise the lower horizontal member 141 above the engaging projection piece 127 and engage the engaging piece 132 of the upper pivotable member 130 somewhat with the engaging recess 148 of the upper horizontal member 140.

(5) Swing the panel 104 further in the direction shown by the arrow so as to engage the engaging piece 121 of the other pivotable member 119 further with the engaging recess 148 to engage the engaging pieces 121, 121 of the left and right pivotable members 119, 119 with the engaging recesses 148, 148 of the left and right vertical members 142, 142 as shown by the solid line in FIG. 6 to thereby mount the engaging pieces 121, 121 on the left and right mullions 101, 101.

(6) Move the panel 104 down so as to engage the engaging piece 127 with the engaging recess 148 of the lower horizontal member 141, and engage the engaging piece 132 of the upper pivotable member 130 with the engaging recess 148 of the upper horizontal member 140.

(7) Fit a retainer piece 149 between the pair of mounting pieces 111, 111 of the bracket body 107 in a snap fit fashion so that the retainer piece 149 may hold the pivotable member 119 to prevent it from swinging to the outdoor side.

(8) Mount the cover members 123 on the transom bodies 122, and then mount the sealing materials at necessary places.

Further, the dismounting of the panel 104 can be made by performing the above-mentioned operation in the reverse sequence.

In the next place, variants of the second embodiment will be described.

Figure 8:
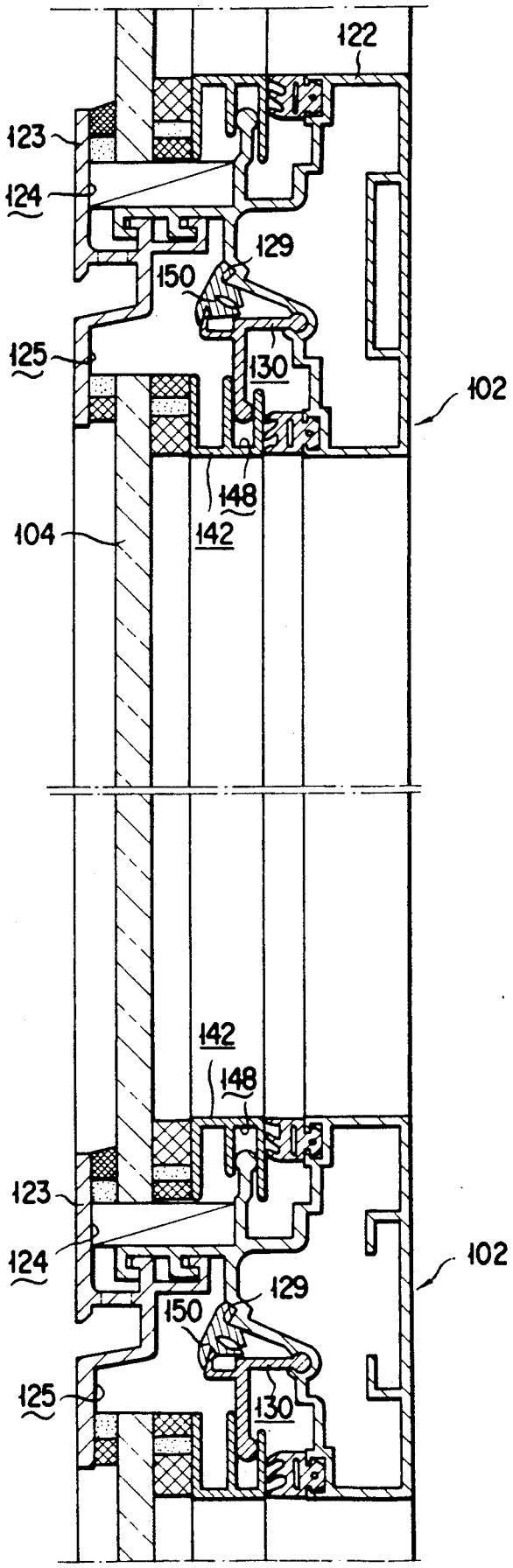
FIGS. 8 to 11 are fragmentary, schematic longitudinal sectional views showing variants of the second embodiment.

As shown in FIG. 8, a floating preventive member 150 made of a resin is mounted between the upper pivotable member 130 and the engaging portion 129 in a snap fit fashion to thereby prevent jumping-up of the upper pivotable member 130.

Figure 9:
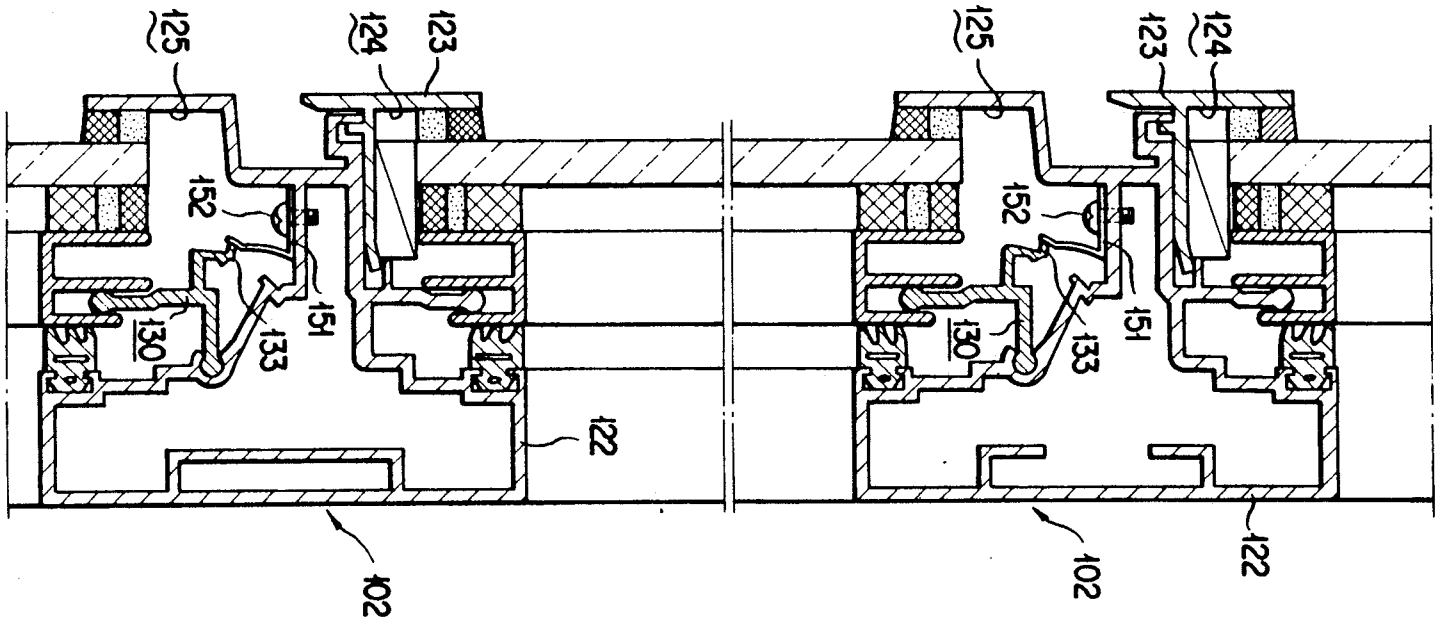

As shown in FIG. 9, an L-shaped leaf spring 151 is mounted on the transom body 122 by means of a screw 152, and the leaf spring 151 is engaged with the engaging portion 133 of the upper pivotable member 130 so as to prevent jumping-up of the upper pivotable member 130.

Figure 10:
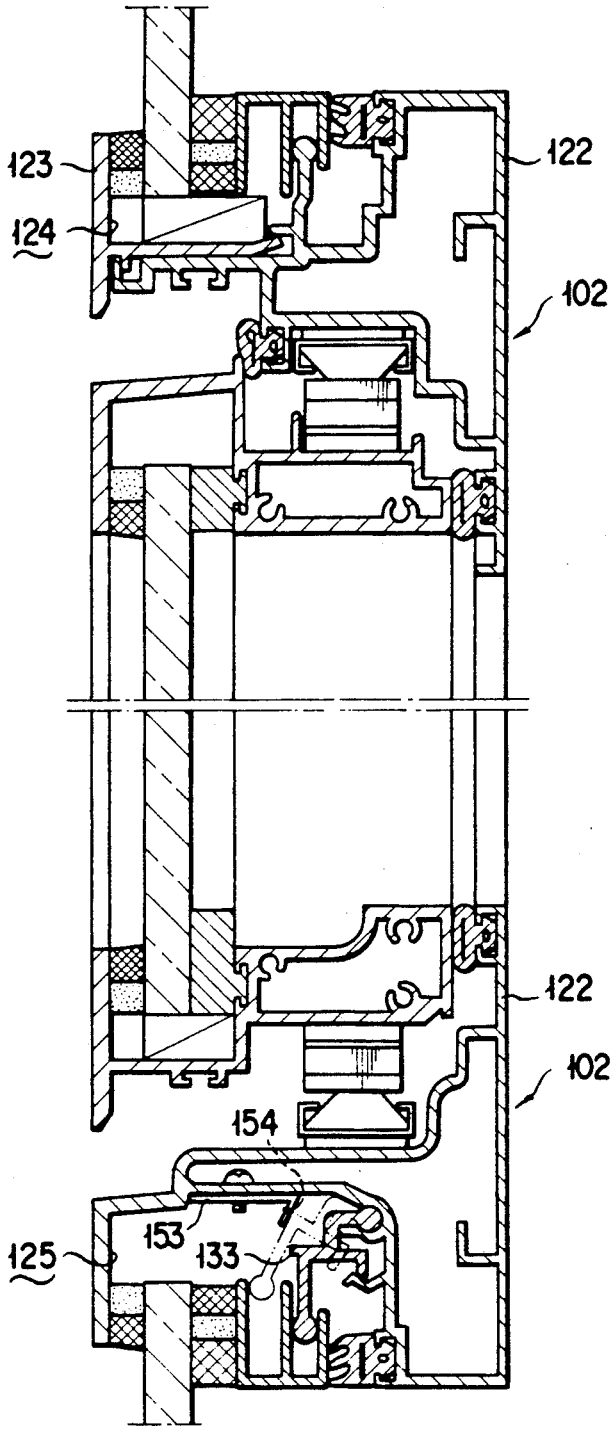

As shown in FIG. 10, a leaf spring 153 is mounted on the transom body 122 by means of a screw, and the free end of the leaf spring 153 is formed with a hole 154 adapted to be engaged with the engaging portion 133. The engaging portion 133 of the upper pivotable member 130 is engaged with the hole 154 to thereby hold the upper pivotable member 130 in its upwardly swung condition.

Further, in the embodiments shown in FIGS. 9 and 10, the downward recess 125 is formed integrally with the transom body 122, and the upward recess 124 is formed by the cover member 123.

Figure 11:
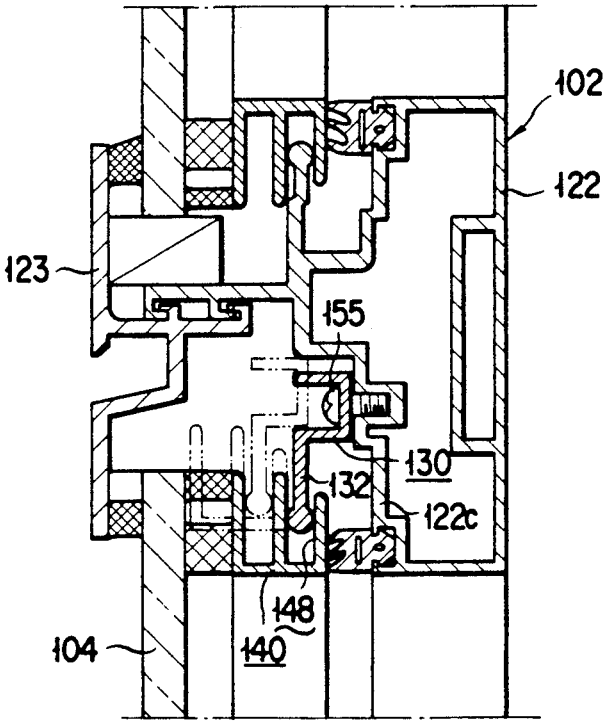

As shown in FIG. 11, the upper pivotable member 130 is connected to a lower wall 122*c* of the transom body 122 by means of a screw 155, and in case of mounting the panel 104, the engaging piece 132 of the upper pivotable member 130 is previously engaged with the engaging recess 148 of the upper horizontal member 140.

Figure 12:
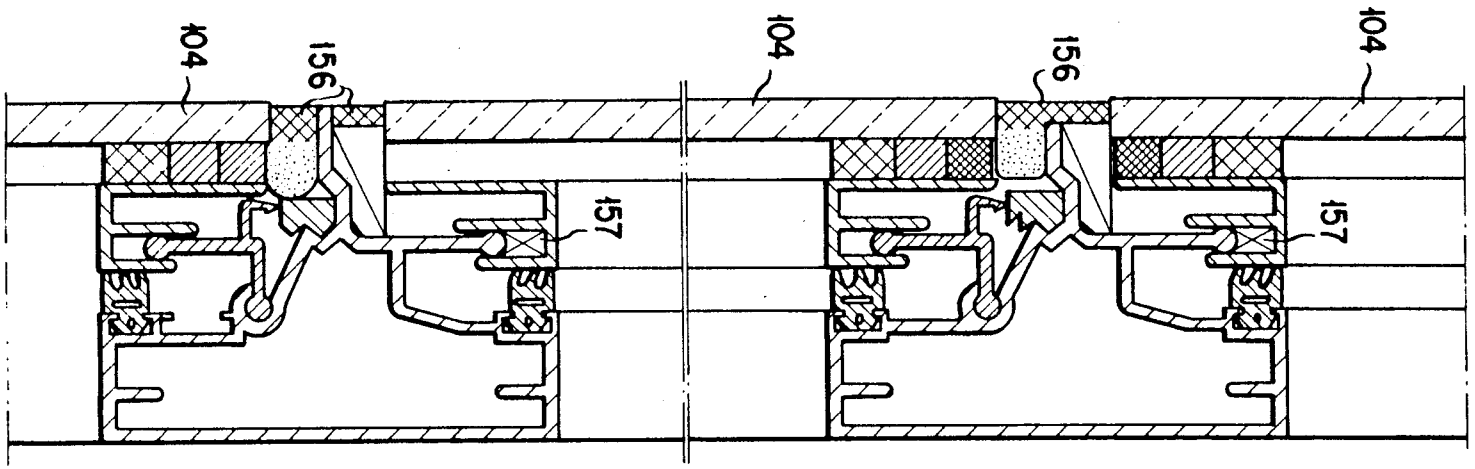
FIG. 12 is a schematic longitudinal sectional view showing exposed outdoor surfaces of upper and lower edges of a panel.

In each of the above-mentioned embodiments, the other surfaces of the upper and lower margins of the panel 104 are supported by the cover members 123 connected to the transom 102. However, as shown in FIG. 12, the outer surfaces of the upper and lower margins of the panel 104 may be dispensed with the cover members 123, and a sealing material 156 may be mounted between the upper and lower panels 104. Reference numeral 157 denotes a self-aligning type block.

Figure 13:
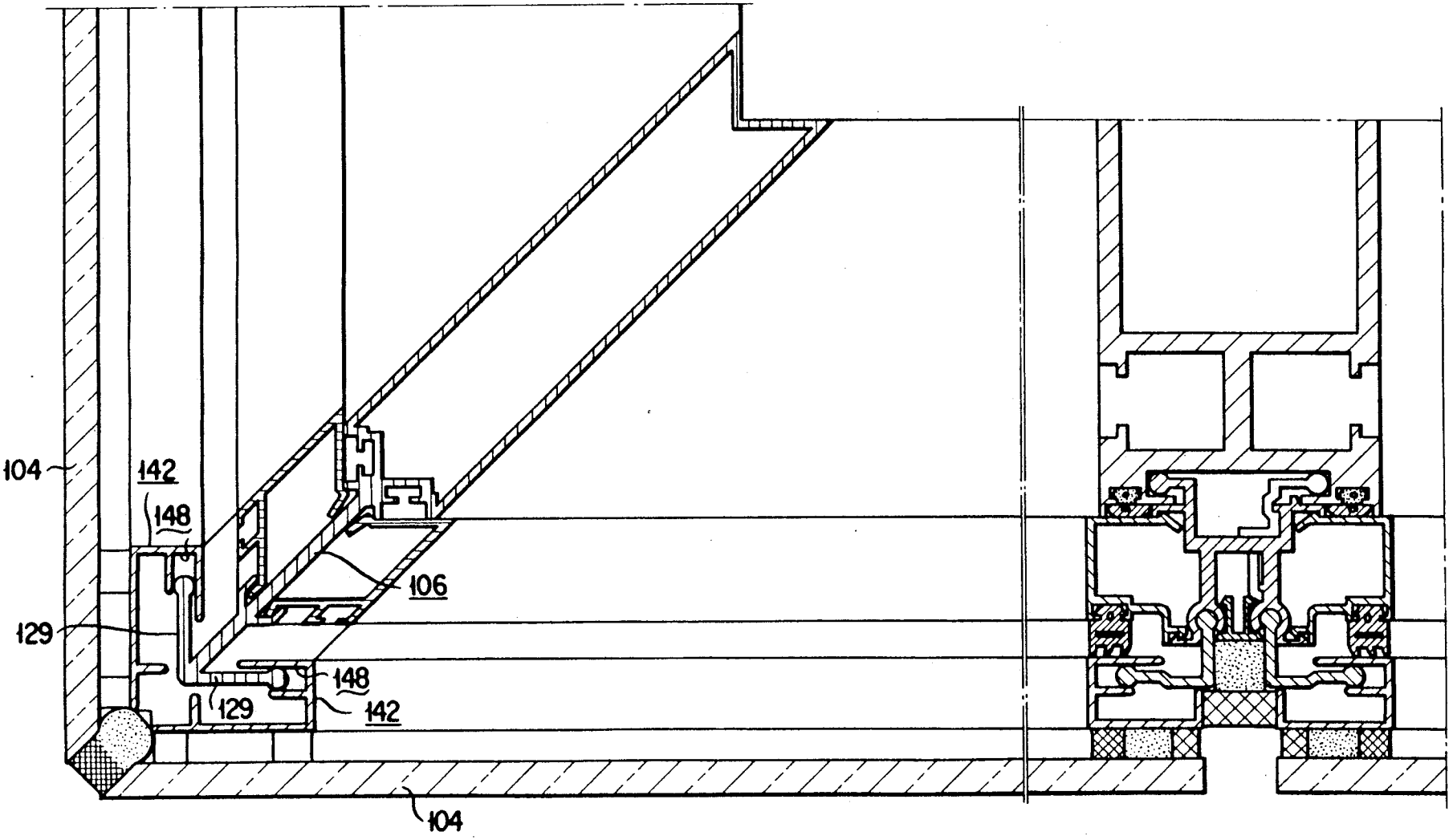
FIG. 13 is a schematic, cross-sectional view showing an embodiment of the corner portion.

FIG. 13 shows a corner portion wherein the panels 104 are mounted as shown in FIG. 12. In the corner portion, a plate-shaped bracket 106 is used, which has a pair of pivotable members 129, 129 formed integrally therewith at a predetermined angle. The pivotable members 129, 129 are engaged with the engaging recesses 148, 148 of the vertical members 142, 142 of a pair of adjacent panels 104, 104 mounted to each other at a predetermined angle.

It is to be understood that foregoing description is merely illustrative of preferred embodiments of the present invention and that the scope of the present invention is not to be limited thereto, but is to be determined by the scope of the appended claims.

What is claimed is:

1. A window on an external wall of a building, comprising: as components for mounting a window frame, at least a pair of left and right connection attachment members fixedly secured to two mutually adjacent portions of an external wall of a building;

at least a pair of left and right pivotable members having inner ends pivotally mounted on the pair of left and right connection attachment members, respectively, such that said left and right pivotable members may be swung freely about respective pivotal axes, said pivotal axes extending parallel to said external wall of said building, said left and right pivotal members having respective engaging pieces formed integrally in outer ends of said left and right pivotal members;

at least a pair of left and right engaging members each having an engaging recess formed therein, said engaging recesses opening so as to be detachably engaged with each of the engaging pieces of the pair of left and right pivotable members; and a panel adhesively bonded along at least inner left and right vertical margins thereof onto outer surfaces of said left and right engaging members, respectively, such that upon mounting the panel each of the engaging pieces of said pair of left and right pivotable members is fitted in each of said engaging recesses formed in said pair of left and right engaging members, respectively.

2. A window as claimed in claim 1, characterized in that said window frame comprises a pair of upper and lower horizontal frame members mounted at predetermined places through said pair of connection attachment means, and a pair of left and right vertical frame members mounted vertically at predetermined intervals between these horizontal frame members and in a parallel relationship with each other, and the pair of left and right vertical frame members serve concurrently as said pair of left and right pivotable means, respectively.

3. A window as claimed in claim 1, characterized in that each of said engaging means comprises jumping-up preventive means.

4. A window as claimed in claim 1, wherein said left and right pivotable members comprise vertical frame members extending substantially along a vertical extent of said panel at each side thereof.

5. A window comprising:

as components for mounting a window frame, at least a pair of left and right connection attachment members fixedly secured to two mutually adjacent portions of an external wall of a building;

at least a pair of left and right pivotable members having inner ends pivotally mounted on said pair of left and right connection attachment members, respectively, such that said left and right pivotable members may be swung freely about respective pivotal axes, and said left and right pivotable members having outer ends integrally formed with respective engaging pieces;

at least a pair of left and right engaging members each having an engaging recess formed therein and which opens so as to be detachably engaged with each of said engaging pieces of said pair of left and right pivotable members;

a panel adhesively bonded onto surfaces of said engaging members along at least inner left and right vertical margins thereof, respectively, each of said engaging pieces of said pair of left and right pivotable members being fitted in each of said engaging recesses formed in said pair of left and right engaging means, respectively, when said panel is mounted;

a pair of adjacent left and right mullions mounted vertically at predetermined intervals in a parallel relationship with each other, and a pair of upper and lower transoms extending horizontally between upper and lower parts of said mullions and connected thereto, said pivotable members comprising a pair of left and right first pivotable members pivotally connected with said pair of left and right connection attachment members and an upper pivotable member pivotally connected with said upper transom, and said engaging members comprising engaging members fixedly attached by adhesive to all peripheral margins of left, right, upper and lower indoor-side portions of said panel.

6. A window as claimed in claim 5, wherein each of said upper and lower transoms comprise a transom body located at an inner position, and a cover member detachably mounted on an outwardly extending horizontal plate of said transom body in such a way as to form an upward recess and a downward recess on an outdoor side of said transom bodies when assembled with the latter.

* * * * *

UNITED STATES PATENT AND TRADEMARK OFFICE

CERTIFICATE OF CORRECTION

PATENT NO. : 5,036,640

DATED : Aug. 6, 1991

INVENTOR(S) : Sotoharu Niwata et al.

It is certified that error appears in the above—identified patent and that said Letters Patent is hereby corrected as shown below:

On the Title page, item [30], Foreign Application Priority Data, please change the first priority listed document from "Dec. 28, 1988 [JP] Japan . . . . 63-32981"

to read

--Dec. 28, 1988 [JP] Japan . . . 63-329381--.

Signed and Sealed this

Twenty-ninth Day of June, 1993

*Attest:*

*Attesting Officer*

Michael K. Kirk

MICHAEL K. KIRK

*Acting Commissioner of Patents and Trademarks*